US009456480B2

(12) United States Patent
Liu et al.

(10) Patent No.: US 9,456,480 B2
(45) Date of Patent: Sep. 27, 2016

(54) DIMMER CIRCUIT AND LED LIGHTING DEVICE HAVING SAID DIMMER CIRCUIT

(71) Applicant: OSRAM GmbH, Munich (DE)

(72) Inventors: Yaping Liu, Guangdong (CN); Zeke Wei, Guangdong (CN); Dan Lin, Guangdong (CN); Yan Li, Guangdong (CN)

(73) Assignee: OSRAM GmbH, Munich (DE)

( * ) Notice: Subject to any disclaimer, the term of this patent is extended or adjusted under 35 U.S.C. 154(b) by 115 days.

(21) Appl. No.: 14/205,610

(22) Filed: Mar. 12, 2014

(65) Prior Publication Data

US 2014/0265904 A1 Sep. 18, 2014

(30) Foreign Application Priority Data

Mar. 12, 2013 (CN) ..... 2013 2 0112025 U

(51) Int. Cl.
*H05B 37/02* (2006.01)
*H05B 33/08* (2006.01)

(52) U.S. Cl.
CPC ..... *H05B 33/0848* (2013.01); *H05B 33/0815* (2013.01); *H05B 33/0854* (2013.01); *H05B 37/02* (2013.01)

(58) Field of Classification Search
CPC ..... H05B 33/08; H05B 37/02
USPC ..... 315/200 R, 224, 225, 247, 276, 287, 315/297, 307, 308
See application file for complete search history.

(56) References Cited

U.S. PATENT DOCUMENTS

| | | | | |
|---|---|---|---|---|
| 8,810,156 | B2 * | 8/2014 | Brassfield | H05B 33/0818 315/291 |
| 9,307,601 | B2 * | 4/2016 | He | H05B 33/0815 |
| 9,313,840 | B2 * | 4/2016 | Grisamore | H05B 33/0815 |
| 2008/0224636 | A1 * | 9/2008 | Melanson | H05B 33/0815 315/307 |
| 2010/0060186 | A1 * | 3/2010 | Taipale et al. | 315/291 |
| 2011/0316446 | A1 * | 12/2011 | Kang et al. | 315/297 |
| 2013/0154487 | A1 * | 6/2013 | Kuang et al. | 315/171 |
| 2013/0221871 | A1 * | 8/2013 | King et al. | 315/254 |

* cited by examiner

*Primary Examiner* — Tung X Le
(74) *Attorney, Agent, or Firm* — Viering, Jentschura & Partner mbB

(57) ABSTRACT

A dimmer circuit may include: a rectification module, a control module and an output module, wherein the control module receives an input signal rectified through the rectification module and controls the output module to supply a load with an output signal in accordance with the input signal, and a compensation module which collects sampled signals characterizing dimming state of the dimmer circuit between the control module and the output module, and supplies the control module with a compensation signal in accordance with the sampled signals, the control module changing the value of the output signal according to the input signal and the compensation signal.

17 Claims, 3 Drawing Sheets

DIMMER CIRCUIT AND LED LIGHTING DEVICE HAVING SAID DIMMER CIRCUIT

RELATED APPLICATIONS

This application claims priority to Chinese Patent Application Serial No. 201320112025.1, which was filed Mar. 12, 2013, and is incorporated herein by reference in its entirety.

TECHNICAL FIELD

Various embodiments relate to a dimmer circuit and an LED lighting device having said dimmer circuit.

BACKGROUND

With rapid development of lighting devices, particularly the development of LED lighting devices having high efficiency and requiring low power, various luminaires applying LED technique are widely applied to every aspect of daily life, for example, indoor lighting or public lighting. Consequently, the requirements of users on electrical performance, mechanical performance and lighting effect of LED lighting devices are increased. At the present, a PSR type LED driver circuit that works based on the phase cut dimming principle is widely applied due to the requirement of the market on product cost. Moreover, higher and higher requirements on dimming range of LED lighting devices having such a driver circuit are made by users, for example, it is required that such an LED lighting device can provide a wider dimming range, and particularly, a deep dimming is further required when said LED lighting device is regulated to the lower limit of the dimming range. Considering these requirements, improvements are provided in the prior art.

In a solution of the prior art, it is provided that an LED lighting device can have a further deep dimming in a situation of reaching the lower limit of the dimming range by adding dissipative elements, such as adding a bleeder circuit, wherein said bleeder circuit is enabled to share partial electrical energy of the whole driver circuit, so as to achieve the object of performing a deep dimming, and the dimming effect thereof is shown in FIG. 1. However, in a situation that a deep dimming might be allowed, a large quantity of unnecessary power dissipation is resulted from such a solution, which renders that a large quantity of electrical energy is consumed and wasted. Moreover, in order to achieve said object, extra dissipative elements have to be added in the circuit. In this case, not only cannot save electrical energy, but also unnecessary cost consumption is generated in such a circuit design.

SUMMARY

In order to solve the above mentioned technical problem, various embodiments provide a novel dimmer circuit. According to various embodiments, a deep dimming is further realized when the LED lighting device is regulated to reach a relatively low dimming level, so as to satisfy the requirements of users on dimming. Moreover, as said dimmer circuit does not perform a deep dimming by utilizing dissipative elements, the power dissipation of the dimmer circuit per se is reduced, and such a dimmer circuit further has the advantages of simple structure and low cost. In addition, various embodiments further relate to an LED lighting device having the dimmer circuit mentioned above.

According various embodiments, said dimmer circuit includes a rectification module, a control module and an output module, wherein the control module receives an input signal f rectified through the rectification module, and controls the output module to supply a load with an output signal in accordance with the input signal, characterized by further comprising a compensation module which collects sampled signals characterizing dimming state of the dimmer circuit between the control module and the output module, and supplies the control module with a compensation signal in accordance with the sampled signals, the control module then changes the value of the output signal according to the input signal and the compensation signal. Through the addition of a compensation module in the dimmer circuit, the control over the driver circuit is realized and the possibility for a further deep dimming is provided, even in a situation that the dimmer circuit reaches to the lower limit of the dimming range, viz. its phase cut angle reaches the minimum value. The term "deep dimming" in the scope of the present disclosure means e.g. increase of the dimming range, or further decrease of the value of the phase cut angle, or decrease of the value of an input signal (e.g. current).

In an embodiment of the present disclosure, the compensation module supplies the control module with the compensation signal when the sampled signal represents a dimming boundary state of the dimmer circuit. In this case, such a design provides the dimmer circuit with a specific dimming mode, which enables a corresponding regulation of the control module in accordance with the condition characterized by the sampled signal, so as to realize the possibility of a deep dimming. It is identified through the sampled signal whether the driver circuit reaches its lower limit of the dimming range, if so, the compensation module begins to work, and supplies the control module with the compensation signal, so as to realize the desired "deep dimming".

In a preferable embodiment according to the present disclosure, the compensation module comprises a sampling unit and a compensation signal generating unit, which acquires a first signal characterizing the sampled signal through the sampling unit and generates the compensation signal in accordance with a comparison result between the first signal and a threshold value. In this case, the compensation module selectively determines whether the dimmer circuit is in the dimming boundary state, so as to decide whether it is necessary to send the compensation signal to the control module.

It is preferable that the compensation signal generating unit comprises a trigger unit and a compensation unit, the trigger unit acquires the first signal through the sampling unit and starts to supply the compensation unit with a trigger signal when the first signal is less than a DC power voltage as the threshold value, while the compensation unit supplies the control module with the compensation signal in accordance with the trigger signal. In this case, through the interaction between the trigger unit and the compensation unit, a signal for further control can be supplied to the control module in accordance with the signal of the sampling unit, so as to effectively and simply regulate the dimming effect of the driver circuit.

It is preferable that the trigger unit comprises a first transistor that turns on and outputs the trigger signal when the first signal is less than the DC power voltage as the threshold value. As core component of the trigger unit, the first transistor simply compares the threshold value and the first signal, and functions in the form of a switching element according to the comparison result, so as to discontinuously supply trigger signals.

It is preferably that the trigger unit further comprises a shunt branch, the reference electrode of the first transistor is in connection with the DC power voltage, the control electrode is in connection with the output of the sampling unit, and the working electrode is grounding through the shunt branch. Said shunt branch provides the trigger unit with environment for stable operation, which assures the safety of said trigger unit and simultaneously ensures the stability of electrical signals.

It is preferable that the shunt branch comprises a first resistor, a second resistor and a first capacitor, the first resistor and the first capacitor connected that are in series are connected in parallel with the second resistor, wherein the output of the trigger unit is located between the first resistor and the first capacitor. Said first and second resistors provide the unit, in which they are present, with electrical signals after current limiting, and realize normal operation of the transistor and ensure the operation safety of the circuit, while the first capacitor has the function of filtering signals to assure the stability of electrical signals.

It is preferable that the compensation unit comprises a second transistor as an amplifier. As core component of the compensation unit, said second transistor supplies proper and stable control signals to a downstream unit according to signals from the upstream unit.

It is preferable that the compensation unit further comprises a voltage stabilizing element, the anode of the voltage stabilizing element is in connection with the control electrode of the second transistor, and the cathode is in connection with the output of the trigger unit. As another core component of said compensation unit, said voltage stabilizing component stabilizes the voltage of said compensation unit, and said compensation unit supplies a downstream unit with electrical signals according to said stabilized voltage.

It is preferable that the voltage stabilizing element is at least one Zener diode. Zener diode is a simple and effective voltage stabilizing element. Thus, one or more Zener diodes connected in series can be selected as voltage stabilizing element according to actual situation.

It is preferable that the compensation unit further comprises a third resistor, one end of the third resistor is in connection with the reference electrode of the second transistor, while the other end is in connection with the control module to provide the compensation signal. The third resistor influences the strength of electrical signals provided by the second transistor for a downstream unit, and the value of the compensation signal can be changed by changing the value of the third resistor.

It is preferable that the sampling unit comprises a voltage dividing branch formed by a fourth resistor and a fifth resistor connected in series, one end of the voltage dividing branch is connected between the control module and the output module, while the other end is grounding. A desired dimming effect can be achieved by properly selecting the values of the fourth and fifth resistors.

It is preferable that the sampling unit further comprises a first diode, the anode of the first diode is connected between the fourth resistor and the fifth resistor, while the cathode of the first diode is in connection with the DC power voltage, and a node between the anode of the first diode and the fifth resistor forms the output of the sampling unit. The first diode defines the flow direction of the electrical signals at this part, and it is prevented thereby that the DC power voltage of high potential flows to the voltage dividing branch.

It is preferable that the sampling unit further comprises a second capacitor which is connected in parallel with the fifth resistor. The second capacitor is capable of filtering unnecessary electrical signals out, and assuring working stability of said sampling unit, so that the downstream compensation unit can work effectively and stably.

It is preferable that the control module comprises an IC controller, wherein the input signal and the compensation signal are respectively inputted into a first input and a second input of the IC controller, and the output of the IC controller supplies the control module with a control signal. According to said control signal, the output current of the output module can have further changes, in particular, can be further lessened.

It is preferable that the output module comprises a third transistor and a transformer, the control electrode of the third transistor is in connection with the output of the IC controller, the working electrode is in connection with a primary coil of the transformer, the reference electrode is on one hand in connection with the second input through a eighth resistor and on the other hand in connection with ground through a sixth resistor. Said third transistor can be a field effect transistor, which, as a core component of said output module, controls the value of signal output of said module, so as to realize variation of output current of the driver circuit.

Various embodiments further provide an LED lighting device. Said LED lighting device includes an LED component as load, and further comprises the dimmer circuit according to the above description. Said dimmer circuit allows the LED lighting device to have a further deep dimming, even when reaching the lower limit of the dimming range.

BRIEF DESCRIPTION OF THE DRAWINGS

In the drawings, like reference characters generally refer to the same parts throughout the different views. The drawings are not necessarily to scale, emphasis instead generally being replaced upon illustrating the principles of the disclosure. In the following description, various embodiments of the disclosure are described with reference to the following drawings, in which.

DETAILED DESCRIPTION OF THE EMBODIMENTS

The following detailed description refers to the accompanying drawing that show, by way of illustration, specific details and embodiments in which the disclosure may be practiced.

Figure 2:
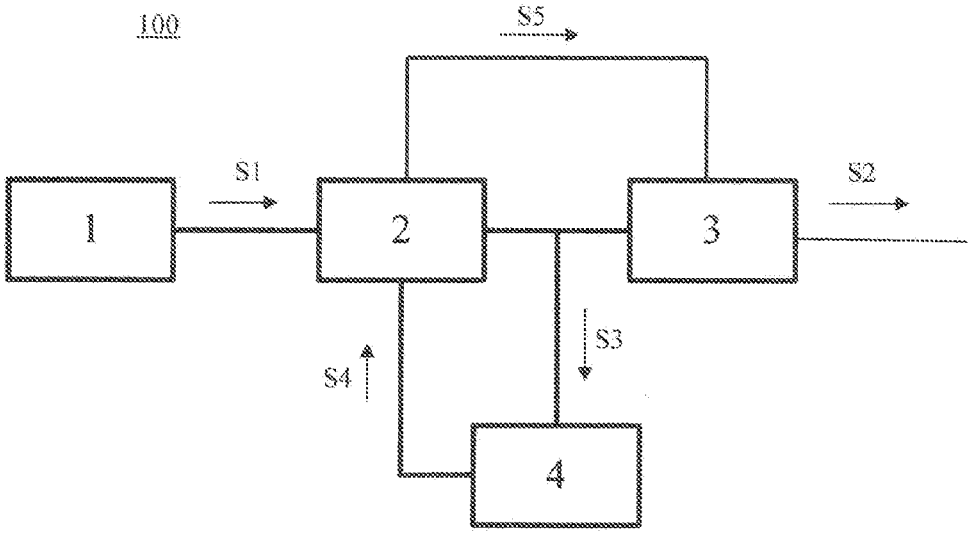
FIG. 2 is a schematic block diagram of a dimmer circuit according to the present disclosure.

FIG. 2 shows a schematic block diagram of a dimmer circuit 100 according to the present disclosure. As shown in FIG. 2, said novel dimmer circuit 100 can be modularized into a plurality of units for realizing different functions, for example: a rectification module 1, a control module 2, an output module 3 and a compensation module 4. The control module 2 receives an input signal S1 from a power network after being rectified through the rectification module 1, and controls the output module 3 to supply a load with an output signal S2 in accordance with the input signal S1. Moreover, in order to achieve the object of the present disclosure, said dimmer circuit 100 further comprises the compensation module 4, which collects sampled signals S3 characterizing dimming state of the dimmer circuit 100 between the control module 2 and the output module 3, and supplies the control module 2 with a compensation signal S4 in accordance with the sampled signal S3, the control module 2 then changes the value of the output signal S2 according to the input signal S1 and the compensation signal S4. Hereby, the object for a deep dimming of the dimmer circuit 100 is achieved.

Figure 3:
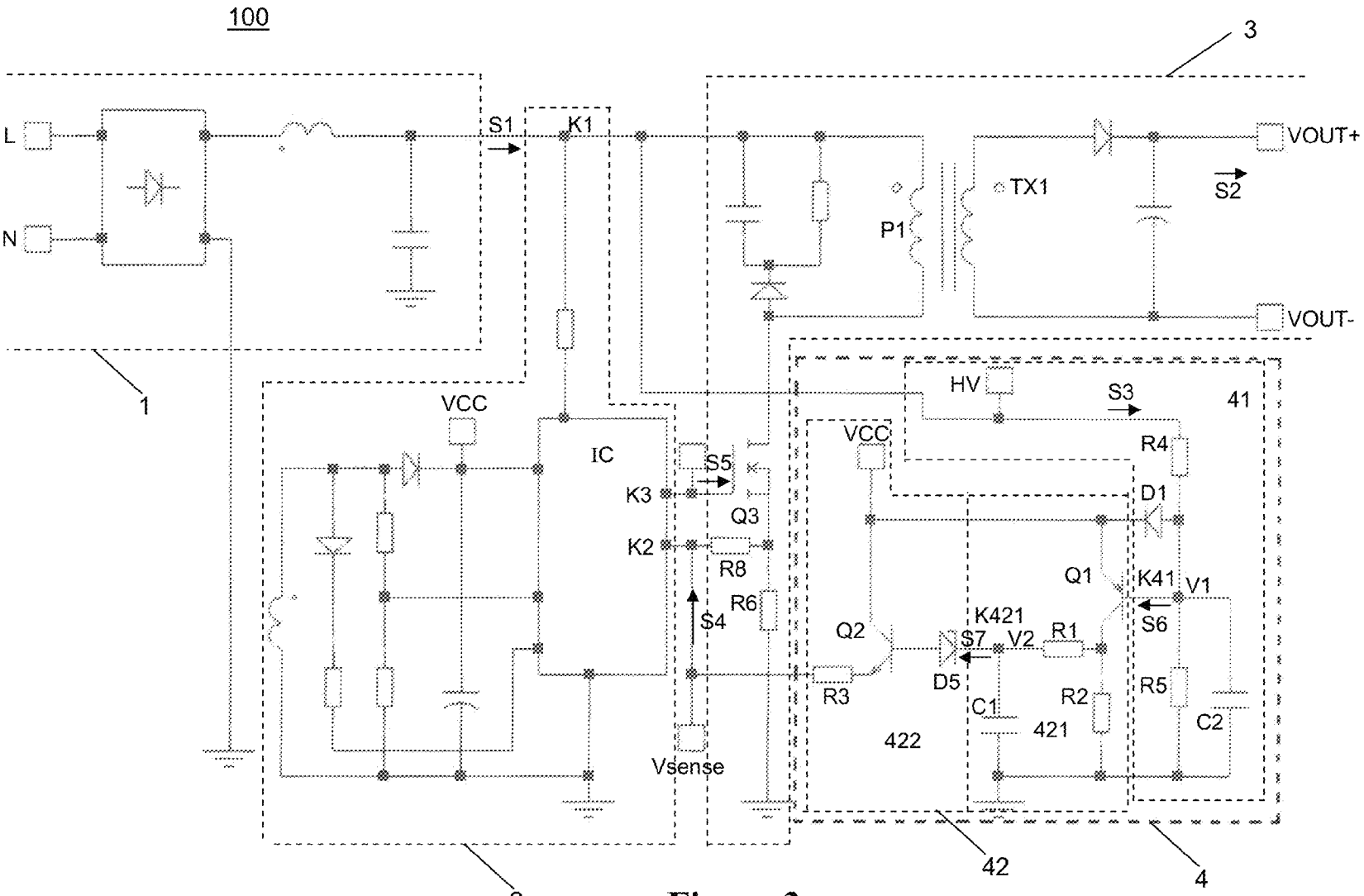
FIG. 3 is the circuit diagram of an embodiment of the dimmer circuit according to the present disclosure.

FIG. 3 shows the circuit diagram of an embodiment of the dimmer circuit 100 according to the present disclosure. As shown in FIG. 3, the compensation module 4 comprises a sampling unit 41 and a compensation signal generating unit 42. Said sampling unit 41 comprises a first diode D1, a fourth resistor R4, a fifth resistor R5 and a second capacitor C2. The second capacitor C2 and the fifth resistor R5 form a bypass circuit after being connected in parallel with each other, wherein the effect of filtering undesired communication signals out can be achieved and the working stability of the sampling unit is assured. The anode of the first diode D1 is connected between the fourth resistor R4 and the fifth resistor R5, and the cathode of the first diode D1 is in connection with a DC power voltage VCC, and a node between the anode of the first diode D1 and the fifth resistor R5 forms the output K41 of the sampling unit 41. Moreover, a voltage dividing branch is formed by the fourth resistor R4 and the fifth resistor R5 that are connected in series, one end of said voltage dividing branch is connected between the control module 2 and the output module 3, while the other end is grounding.

In this case, the compensation signal generating unit 42 acquires a first signal S6 characterizing the sampled signal S3 through the sampling unit 41 described above and generates the compensation signal S4 in accordance with a comparison result between the first signal S6 and a threshold value. The compensation module 4 supplies the control module 2 with the compensation signal S4, when the sampled signal S3 represents a dimming boundary state of the dimmer circuit 100, viz. when reaching the lower limit of the dimming range.

FIG. 3 further shows that the compensation signal generating unit 42 further comprises a trigger unit 421 and a compensation unit 422. The trigger unit 421 comprises a first transistor Q1, a first resistor R1, a second resistor R2 and a first capacitor C1. The first transistor Q1 turns on and outputs a trigger signal S7, when the first signal S6 is less than the DC power voltage VCC as the threshold value. Moreover, the first resistor R1, the second resistor R2 and the first capacitor C1 form a shunt branch, in particular, the first resistor R1 and the first capacitor C1 that are connected in series are connected in parallel with the second resistor R2, wherein the output K421 of the trigger unit 421 is located between the first resistor R1 and the first capacitor C1. The reference electrode of the first transistor Q1 is in connection with the DC power voltage VCC, the control electrode is in connection with the output K41 of the sampling unit 41, and the working electrode is grounding through the shunt branch. The trigger unit 421 acquires the first signal S6 through the sampling unit 41 and opens to supply the compensation unit 422 with the trigger signal S7 when the first signal S6 is less than the DC power voltage VCC as the threshold value, while the compensation unit 422 supplies the control module 2 with the compensation signal S4 in accordance with the trigger signal S7.

The compensation unit 422, as shown in FIG. 3, comprises a second transistor Q2, a voltage stabilizing element and a third resistor R3. As an amplifier, the second transistor Q2 supplies the downstream unit, viz. the control module 2, with a proper and stable compensation signal S4 according to the trigger signal S7 from the upstream unit, viz. the trigger unit 42. Moreover, one Zener diode D5 is used here as voltage stabilizing element, the anode of said voltage stabilizing element is in connection with the control electrode of the second transistor Q2, and the cathode is in connection with the output K421 of the trigger unit 421. Furthermore, the third resistor R3 functioning for current limiting has one end in connection with the reference electrode of the second transistor Q2, and the other end in connection with the control module 2 to provide the compensation signal S4.

In an unshown embodiment, a plurality of Zener diodes connected in series can be used as voltage stabilizing element.

FIG. 3 further shows a detailed drawing of the control module 2 and the output module 3. The control module 2 comprises an IC controller IC, wherein the input signal S1 and the compensation signal S4 are respectively inputted into a first input K1 and a second input K2 of the IC controller IC, and the output K3 of the IC controller IC supplies the control module 3 with the control signal S5. The output module 3 comprises a third transistor Q3 and the transformer TX1, the control electrode of the third transistor Q3 is in connection with the output K3 of the IC controller IC, the working electrode is in connection with a primary coil P1 of the transformer TX1, the reference electrode is on one hand in connection with the second input K2 through a eighth resistor R8 and on the other hand in connection with ground through a sixth resistor R6. In this way, through the third resistor R3, the compensation unit 422 can supply the control module 2 with the compensation signal S4 combined with the eighth resistor R8, so as to realize further control over the output module 3, specifically, can influence the main current of the transistor Q3 of the output module 3 for instance.

$$Ip = \frac{(V2 - VD5 - Vsense) * \frac{R8}{R3} + Vsense}{R6},$$

wherein V2 represents the voltage at the node K421, VD5 represents the voltage of the voltage stabilizing element D5, Vsense, viz. the compensation signal S4, represents the voltage between the eighth resistor R8 and the third resistor R3.

Figure 1:
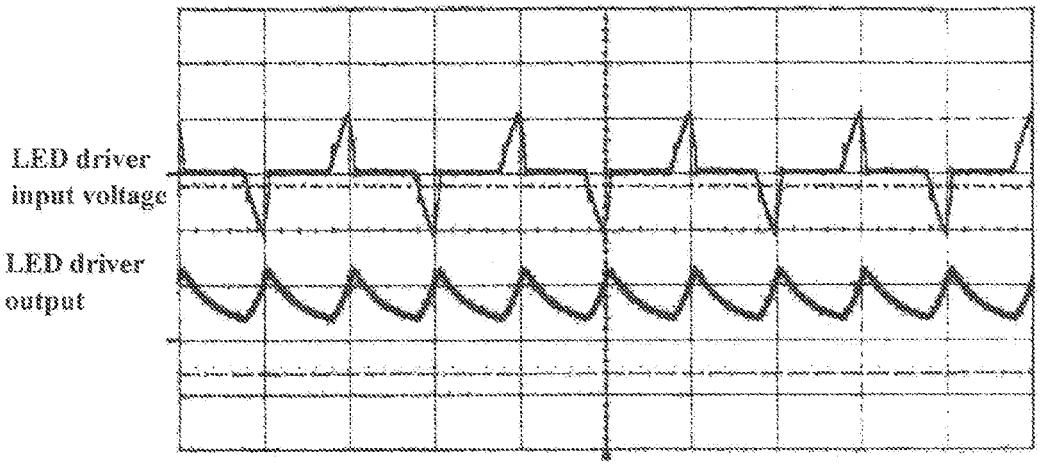
Prior Art Figure 1
FIG. 1 is a schematic diagram of the output current of a dimmer circuit without the compensation unit (the prior art)
Figure 4:
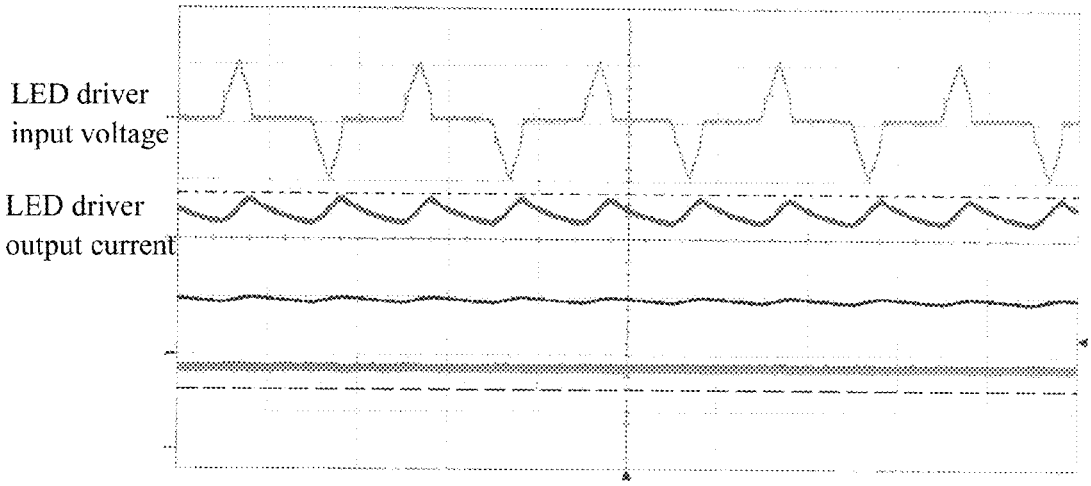
FIG. 4 is a schematic diagram of the output current of the dimmer circuit according to the present disclosure.

By comparing the schematic diagrams of output current of a dimmer circuit 100 respectively shown in FIG. 1 (the prior art) and FIG. 4 (in accordance with the present disclosure), the effect of "deep dimming" realized by the dimmer circuit 100 according to the present disclosure can be clearly identified. For example, during a dimming process, in a situation of the same input voltage, the value of the output current Io1 of the dimmer circuit according to the prior art is relatively larger, as shown in FIG. 1; while the value of the output value Io2 of the dimmer circuit 100 with the compensation module 4 according to the present disclosure is less with respect to Io1, as shown in FIG. 4. Through the comparison between the output currents Io1 and Io2 of FIGS. 1 and 4, it can be determined that a less output current can be obtained in the embodiment of the dimmer circuit 100 according to the present disclosure, compared with a dimmer circuit without a compensation module.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

1 rectification module
2 control module
3 output module
4 compensation module
41 sampling unit
42 compensation signal generating unit
421 trigger unit
422 compensation unit
R1 first resistor
R2 second resistor
R3 third resistor
R4 fourth resistor
R5 fifth resistor
R6 sixth resistor
R8 eighth resistor
C1 first capacitor
C2 second capacitor
Q1 first transistor
Q2 second transistor
Q3 third transistor
D1 first diode
D5 voltage stabilizing element/Zener diode
S1 input signal
S2 output signal
S3 sampled signal
S4 compensation signal
S5 control signal
S6 first signal
S7 trigger signal
K1 first input of the control module
K2 second input of the control module
K3 output of the control unit
K41 output of the sampling unit
K421 output of the trigger unit
P1 primary coil
IC IC controller
TX1 transformer

What is claimed is:

1. A dimmer circuit comprising: a rectification module, a control module and an output module, wherein the control module receives an input signal rectified through the rectification module and controls the output module to supply a load with an output signal in accordance with the input signal, and a compensation module which collects sampled signals characterizing dimming state of the dimmer circuit between the control module and the output module, and supplies the control module with a compensation signal in accordance with the sampled signals, the control module changing the value of the output signal according to the input signal and the compensation signal.

2. The dimmer circuit according to claim 1, wherein the compensation module supplies the control module with the compensation signal when the sampled signal characterizes that the dimmer circuit is in dimming boundary state.

3. The dimmer circuit according to claim 1, wherein the compensation module comprises a sampling unit and a compensation signal generating unit which acquires a first signal characterizing the sampled signal through the sampling unit and generates the compensation signal in accordance with a comparison result between the first signal and a threshold value.

4. The dimmer circuit according to claim 3, wherein the compensation signal generating unit comprises a trigger unit and a compensation unit, the trigger unit acquires the first signal through the sampling unit and starts to supply the compensation unit with a trigger signal when the first signal is less than a DC power voltage as the threshold value, while the compensation unit supplies the control module with the compensation signal in accordance with the trigger signal.

5. The dimmer circuit according to claim 4, wherein the trigger unit comprises a first transistor which turns on and outputs the trigger signal when the first signal is less than the DC power voltage.

6. The dimmer circuit according to claim 5, wherein the trigger unit further comprises a shunt branch, the reference electrode of the first transistor is in connection with the DC power voltage, the control electrode is in connection with the output of the sampling unit, and the working electrode is grounding through the shunt branch.

7. The dimmer circuit according to claim 6, wherein the shunt branch comprises a first resistor, a second resistor and a first capacitor, the first resistor and the first capacitor that are connected in series are connected in parallel with the second resistor, wherein the output of the trigger unit is located between the first resistor and the first capacitor.

8. The dimmer circuit according to claim 4, wherein the compensation unit comprises a second transistor as an amplifier.

9. The dimmer circuit according to claim 8, wherein the compensation unit further comprises a voltage stabilizing element, the anode of the voltage stabilizing element is in connection with the control electrode of the second transistor, and the cathode is in connection with the output of the trigger unit.

10. The dimmer circuit according to claim 9, wherein the voltage stabilizing element is at least one Zener diode.

11. The dimmer circuit according to claim 8, wherein the compensation unit further comprises a third resistor, one end of the third resistor is in connection with the reference electrode of the second transistor, and the other end is in connection with the control module to provide the compensation signal.

12. The dimmer circuit according to claim 4, wherein the sampling unit comprises a voltage dividing branch formed by a fourth resistor and a fifth resistor connected in series, one end of the voltage dividing branch is connected between the control module and the output module, and the other end is grounding.

13. The dimmer circuit according to claim 12, wherein the sampling unit further comprises a first diode, the anode of the first diode is connected between the fourth resistor and the fifth resistor, and the cathode of the first diode is in connection with the DC power voltage, and a node between the anode of the first diode and the fifth resistor forms the output of the sampling unit.

14. The dimmer circuit according to claim 12, wherein the sampling unit further comprises a second capacitor connected in parallel with the fifth resistor.

15. The dimmer circuit according to claim 4, wherein the control module comprises an IC controller, wherein the input signal and the compensation signal are respectively inputted into a first input and a second input of the IC controller, and the output of the IC controller supplies the control module with a control signal.

16. The dimmer circuit according to claim 15, wherein the output module comprises a third transistor and a transformer, the control electrode of the third transistor is in connection with the output of the IC controller, the working electrode is in connection with a primary coil of the transformer, the reference electrode is on one hand in connection with the second input through a eighth resistor and on the other hand in connection with ground through a sixth resistor.

17. An LED lighting device comprising an LED component as a load, comprising a dimmer circuit, the dimmer circuit comprising: a rectification module, a control module and an output module, wherein the control module receives an input signal rectified through the rectification module and controls the output module to supply the load with an output signal in accordance with the input signal, and a compensation module which collects sampled signals characterizing dimming state of the dimmer circuit between the control module and the output module, and supplies the control module with a compensation signal in accordance with the sampled signals, the control module changing the value of the output signal according to the input signal and the compensation signal.

* * * * *